US005546465A

United States Patent [19]

Kim

[11] Patent Number: 5,546,465

[45] Date of Patent: Aug. 13, 1996

[54] AUDIO PLAYBACK APPARATUS AND METHOD

[75] Inventor: Jae-young Kim, Suwon, Rep. of Korea

[73] Assignee: Samsung Electronics Co. Ltd., Kyungki-do, Rep. of Korea

[21] Appl. No.: 341,922

[22] Filed: Nov. 16, 1994

[30] Foreign Application Priority Data

Nov. 18, 1993 [KR] Rep. of Korea ..... 93-24617

[51] Int. Cl.[6] ..... H04S 5/02

[52] U.S. Cl. ..... 381/18; 381/63; 381/17

[58] Field of Search ..... 381/17, 22, 23, 381/63, 18

[56] References Cited

U.S. PATENT DOCUMENTS 5,261,005 11/1993 Masayuki ..... 381/18
5,436,975 7/1995 Lowe et al. ..... 381/63
5,459,790 10/1995 Scofield et al. ..... 381/25

*Primary Examiner*—Forester W. Isen
*Attorney, Agent, or Firm*—Sughrue, Mion, Zinn, Macpeak & Seas

[57] ABSTRACT

An audio playback apparatus and method are disclosed which includes a Dolby pro-logic decoder for converting a digital audio signal into a left signal, a right signal, a center signal, and a surround signal; a sound field processor for converting the left, right, center and surround signals into a front left signal, a front right signal, a rear left signal, and a rear right signal; an audio processor for mixing the left, right, front left, front right, rear left and rear right signals according to a predetermined relationship equation and converting them into signals for two channels composed of a left-speaker output signal and a right-speaker output signal; and audio output means for outputting the left-speaker output signal via a left speaker, the right-speaker output signal via a right speaker, and the center signal via a central speaker, thereby allowing a listener to feel a rich sound presence even with fewer output speakers then with conventional audio playback apparatuses.

9 Claims, 4 Drawing Sheets

AUDIO PLAYBACK APPARATUS AND METHOD

BACKGROUND OF THE INVENTION

The present invention relates generally to an audio playback apparatus and method for an audio system, and more particularly, to an audio playback apparatus and method for outputting sounds containing a sound field in order to better appreciate performances.

A sound field is an indication of audio peculiarities which are generated in accordance with the environment of a given location, such as a concert hall, excluding the sounds actually played therein, such as a performance. A sound field is made up of a direct wave reaching a listener's ear directly from the point of sound origin (e.g., a stage), and a group of reflection waves reflected by the walls, ceiling and floor (as well as other permanently fixed obstacles) and thereby reaching the listener's ear at a time determined according to the distance from the sound source. Further, the reflection wave group is divided into two subgroups: one sub-group of waves which is first reflected by the left and right walls, and the other which is repeatedly reflected and re-reflected after the first reflection to thereby reach the listener's ear from all directions and in an irregular pattern.

Along with efforts to reproduce the original sound of a high-quality sound source, significant improvement has been achieved with respect to frequency characteristics or dynamic range, with the advent of digital audio players such as a compact disk player or digital audio tape player. However, an audio playback technique for reproducing the sound produced in a concert hall or studio like the original sound in a listening room is unsatisfactory at present, in view of the space and time dimensions of the original sound.

In a recently developed audio/video system, since a transmission technique for audio and video signals is unsatisfactory for transmitting a sufficient amount of information, and particularly, since images are planar, the spatial audio playback technique is more of a necessity in the reproduction of sound with a feeling of presence.

In FIG. 1, a conventional audio playback apparatus comprises a Dolby pro-logic decoder 11 and a sound field processor 12, and outputs audio signals L, R, C, FL, FR, RL and RR for seven channels.

An audio signal digitized in an audio signal processor (not shown) of an audio system is input to Dolby pro-logic decoder 11. Dolby pro-logic decoder 11 separates and outputs the input audio signal into four signals: a left signal L, a right signal R, a center signal C, and a surround signal S.

The left signal L, right signal R, center signal C, and surround signal S are input to sound field processor 12, which converts and outputs them into four sound field signals: a front left signal FL, a front right signal FR, a rear left signal RL, and a rear right signal RR.

In the conventional technology, the audio signal is reproduced via two channels for left and right signals, or reproduced via seven channels for the left signal, right signal and center signal L, R and C which are the output signals of Dolby pro-logic decoder 11, and the front left signal FL, front right signal FR, rear left signal RL and rear right signal RR which are the output signals of sound field processor 12, while containing a sound field.

With a conventional audio system in which audio signals are output through two channels for left and right signals, a listener cannot feel a "presence" quality of the sound. For a feeling of presence, a sound-field signal and a Dolby pro-logic signal are coupled to output audio signals for seven channels. For the listening environment of an ordinary home environment, however, it is not easy to install rear speakers, and moreover, a power amplifier and speakers for rear outputs are also required.

SUMMARY OF THE INVENTION

In order to overcome such problems described above, it is an object of the present invention to provide an audio playback apparatus and method in which audio signals for seven channels made up of a sound-field signal and a Dolby pro-logic signal are converted into signals for fewer channels, while containing the sound-field signal.

To accomplish the object of the present invention, there is provided an audio playback apparatus comprising Dolby pro-logic decoding means for converting a digital audio signal into a left signal, a right signal, a center signal, and a surround signal; sound field processing means for converting the left, right, center and surround signals into a front left signal, a front right signal, a rear left signal, and a rear right signal; audio processing means for mixing the left, right, front left, front right, rear left and rear right signals according to a relationship equation and converting them into a two channel signal comprised of a left-speaker output signal and a right-speaker output signal; and audio output means for outputting the left-speaker output signal via a left speaker, the right-speaker output signal via a right speaker, and the center signal via a central speaker.

Further, a method is provided which includes the steps of converting a digital audio signal into a left signal, a right signal, a center signal, and a surround signal; converting said left, right, center and surround signals into a front left signal, a front right signal, a rear left signal, and a rear right signal; and mixing said left, right, front left, front right, rear left and rear right signals according to a relationship equation and converting them into a two channel signal comprised of a left-speaker output signal and a right-speaker output signal.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF A PREFERRED EMBODIMENT

Figure 1:
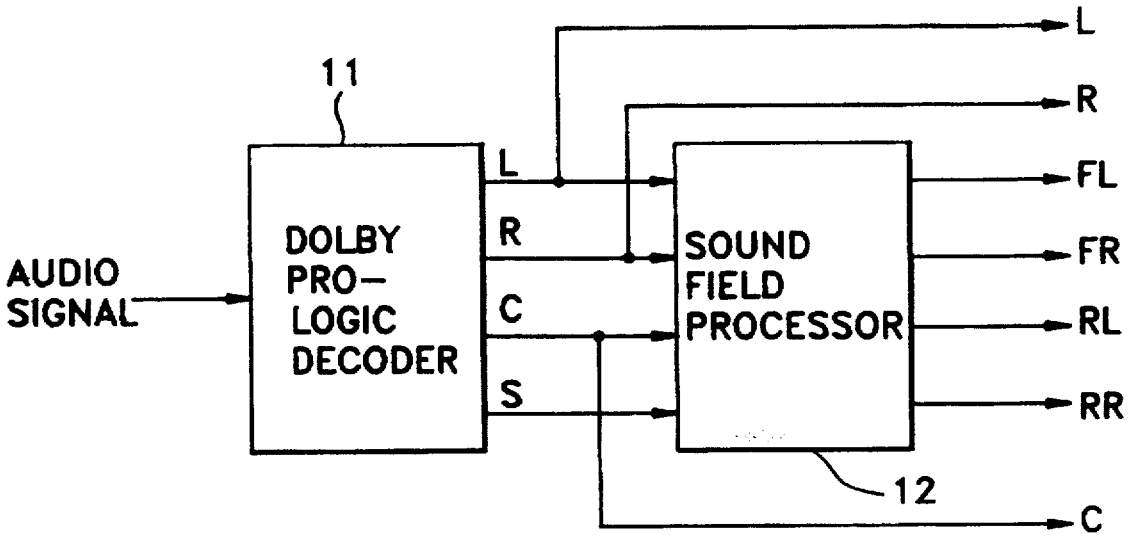
FIG. 1 (PRIOR ART)
FIG. 1 is a block diagram of a conventional audio playback apparatus.
Figure 2:
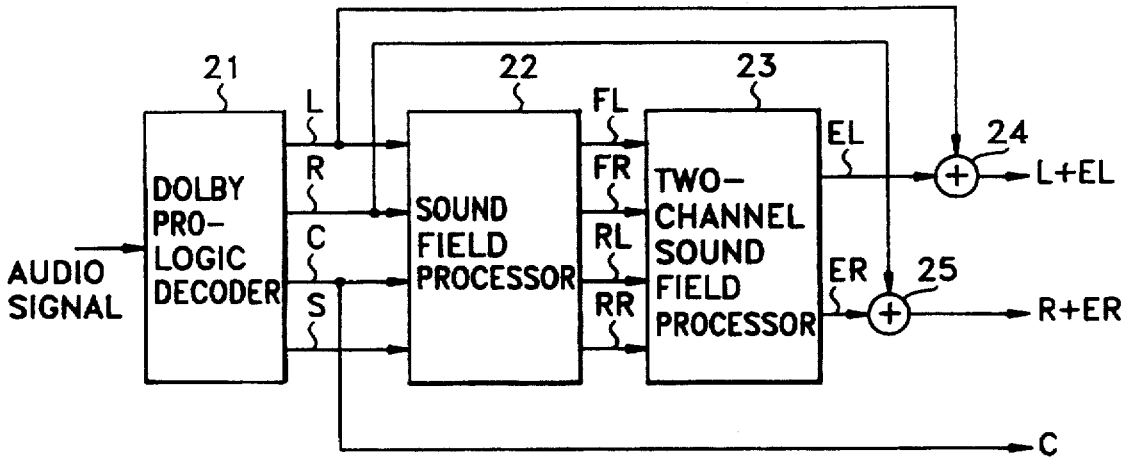
FIG. 2 is a block diagram of an audio playback apparatus of the present invention.

Referring to FIG. 2, an audio playback apparatus of the present invention, comprising a Dolby pro-logic decoder 21, a sound field processor 22, a two-channel sound field processor 23 and first and second signal mixers 24 and 25, is designed to convert audio signals for seven channels into audio signals for three channels, namely, the signals L+EL, R+ER and C.

An audio signal digitized by an audio signal processor (not shown) of an audio system, is input to Dolby pro-logic decoder 21. Dolby pro-logic decoder 21 separates and outputs the input audio signal into four signals: a left signal L, a right signal R, a center signal C, and a surround signal S.

The left signal L, right signal R, center signal C, and surround signal S are input to sound field processor 22, which converts them into four sound field signals: a front left signal FL, a front right signal FR, a rear left signal RL, and a rear right signal RR.

Two-channel sound field processor 23 mixes front left signal FL, front right signal FR, rear left signal RL, and rear right signal RR, and converts them into sound field signals for two channels: left sound field signal EL and right sound field signal ER. A first signal mixer 24 mixes left sound field signal EL and left signal L of Dolby pro-logic decoder 21, and generates a signal L+EL output via the left speaker. A second signal mixer 25 mixes right sound field signal ER and right signal R of Dolby pro-logic decoder 21, and generates a signal R+ER output via the right speaker. The center signal C output from Dolby pro-logic decoder 21 is output via the central speaker. Therefore, the audio playback apparatus of the present invention is able to reproduce audio signals containing a sound field signal employing only three channels.

Figure 3:
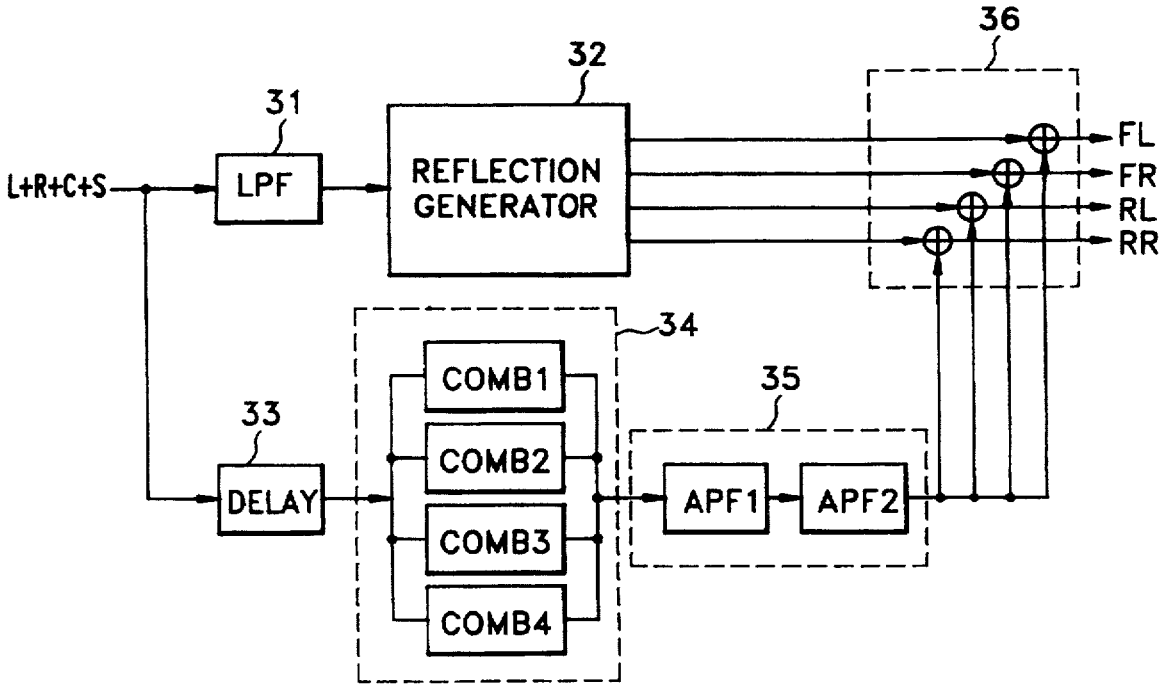
FIG. 3 is a block diagram of the sound field processor shown in FIG. 2.

Referring to FIG. 3, the sound field processor converts left, right, center and surround signals L, R, C and S into a sound field signal made up of a reflection sound and reverberation. A reflection sound portion of the sound field processor consists of a low-pass filter (LPF) 31 for controlling signal characteristics in accordance with signal frequency, depending upon the sound absorption properties of walls and the like, and a reflection generator 32 for generating a reflection sound by using an external memory device such as a DRAM. A reverberation portion of the sound field processor comprises a delay circuit 33 for controlling a predetermined time delay between the reflection sound and reverberation, four comb filters 34 for controlling the magnitude and period of the reverberation, and two all-pass filters (APF) 35. A signal mixer 36 mixes the reflection sound and reverberation, and outputs four sound field signals corresponding to the front left FL, front right FR, rear left RL and rear right RR signals.

Figure 4:
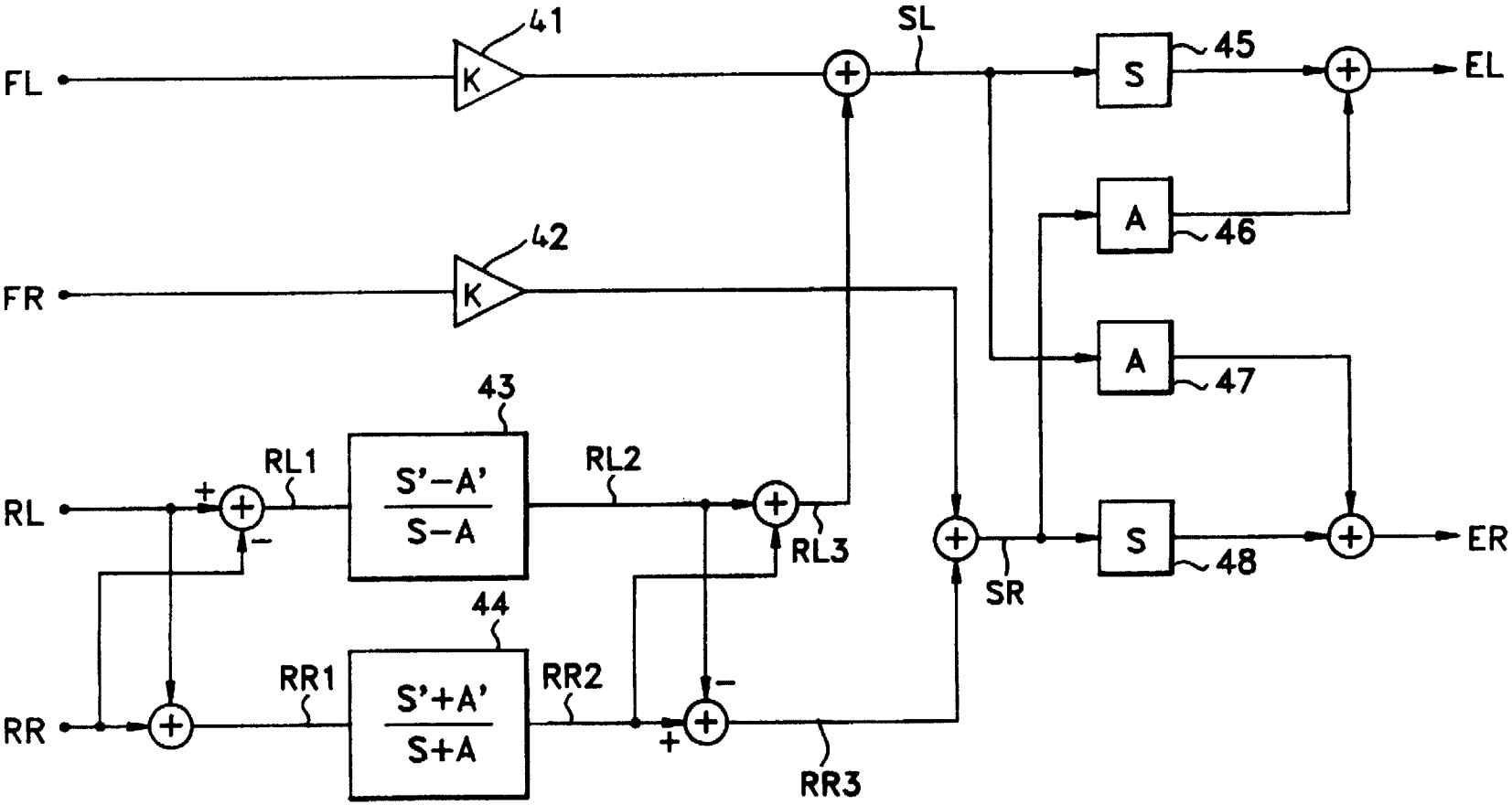
FIG. 4 illustrates a schematic diagram of a circuit that performs an algorithm for the two-channel sound field processor shown in FIG. 2.

FIG. 4 schematically illustrates an example of a circuit which performs an algorithm with which two-channel sound field processor 23 of FIG. 2 converts the four sound field signals into sound field signals for two channels. First front leveler 41 and second front leveler 42 function to match the sound pressure levels of front sound sources FL and FR to those of rear sound sources RL and RR. Here, K is an arbitrary coefficient determined for sound pressure matching between front sound sources FL and FR and rear sound sources RL and RR. Filters 43, 44, 45, 46, 47 and 48 convert input signals according to transfer functions discussed below. Operation devices, such as the adders shown in FIG. 4, mix signals input thereto.

Functions S, A, S' and A' used in the filters indicate a sound source transmission characteristic relationship between a sound source and a listener's ear, as prescribed by the position of the sound source and the listener's sense of hearing.

Figure 5:
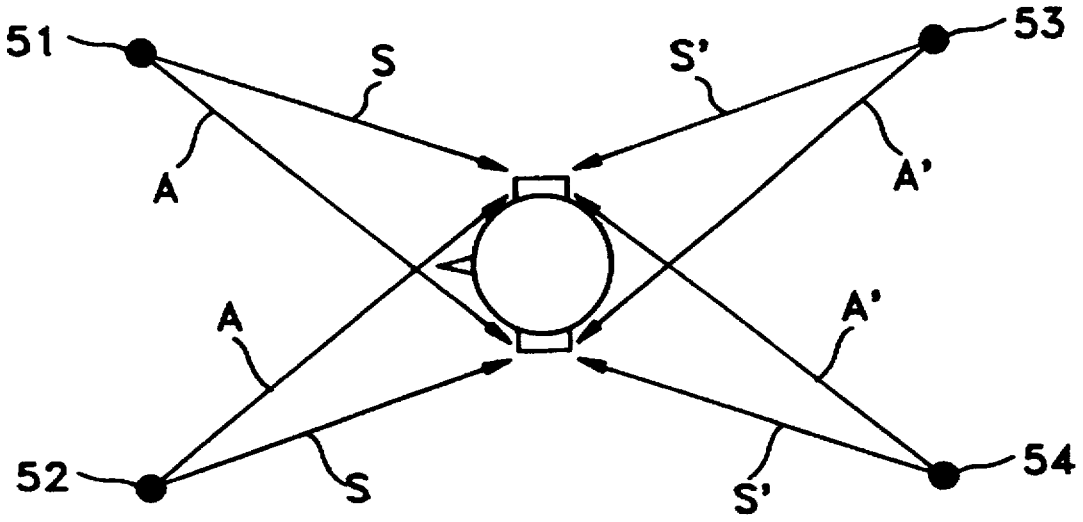
FIG. 5 spatially illustrates a transfer function between a sound source and a listener.

FIG. 5 is a diagram for illustrating the function of the sound source transmission characteristic between the various sound sources and the listener's ear. A direct sound transmission function corresponding to the path between front sound sources 51 and 52 and the listener's ear closest to the respective front sound sources is represented by the symbol S. An indirect sound transmission function corresponding to the path between front sound sources 51 and 52 and the listener's ear farthest away from the respective rear sound source is represented by the symbol A. Moreover, a direct sound transmission function and an indirect sound transmission function for rear right sound source 53 and rear left sound source 54 are represented by symbols S' and A', respectively.

According to the algorithm of FIG. 4, the relationship between the inputs and outputs of the two-channel sound field processor is given according to the following equations, using the reference characters and filter functions indicated in the drawings.

$$\begin{bmatrix} RL1 \\ RR1 \end{bmatrix} = \begin{bmatrix} 1, & -1 \\ 1, & 1 \end{bmatrix} \begin{bmatrix} RL \\ RR \end{bmatrix}$$

$$\begin{bmatrix} RL2 \\ RR2 \end{bmatrix} = \begin{bmatrix} \frac{S'-A'}{S-A}, & 0 \\ 0, & \frac{S'+A'}{S+A} \end{bmatrix} \begin{bmatrix} RL1 \\ RR1 \end{bmatrix}$$

$$= \begin{bmatrix} \frac{S'-A'}{S-A}, & 0 \\ 0, & \frac{S'+A'}{S+A} \end{bmatrix} \begin{bmatrix} 1, & -1 \\ 1, & 1 \end{bmatrix} \begin{bmatrix} RL \\ RR \end{bmatrix}$$

$$= \begin{bmatrix} \frac{S'-A'}{S-A}, & \frac{-(S'-A')}{S-A} \\ \frac{S'+A'}{S+A}, & \frac{S'+A'}{S+A} \end{bmatrix} \begin{bmatrix} RL \\ RR \end{bmatrix}$$

-continued $$\begin{bmatrix} RL3 \\ RR3 \end{bmatrix} = \begin{bmatrix} 1, & 1 \\ -1, & 1 \end{bmatrix} \begin{bmatrix} RL2 \\ RR2 \end{bmatrix}$$

$$= \begin{bmatrix} 1, & 1 \\ -1, & 1 \end{bmatrix} \begin{bmatrix} \frac{S'-A'}{S-A}, & \frac{-(S'-A')}{S-A} \\ \frac{S'+A'}{S+A}, & \frac{S'+A'}{S+A} \end{bmatrix} \begin{bmatrix} RL \\ RR \end{bmatrix}$$

$$= \frac{2}{(S+A)(S-A)} \begin{bmatrix} SS'-AA', & SA'-AS' \\ SA'-AS', & SS'-AA' \end{bmatrix} \begin{bmatrix} RL \\ RR \end{bmatrix}$$

$$\begin{bmatrix} SL \\ SR \end{bmatrix} = \begin{bmatrix} RL3 \\ RR3 \end{bmatrix} + K \begin{bmatrix} 1, & 0 \\ 0, & 1 \end{bmatrix} \begin{bmatrix} FL \\ FR \end{bmatrix}$$

$$= \frac{2}{(S+A)(S-A)} \begin{bmatrix} SS'-AA', & SA'-AS' \\ SA'-AS', & SS'-AA' \end{bmatrix} \begin{bmatrix} RL \\ RR \end{bmatrix} + K \begin{bmatrix} 1, & 0 \\ 0, & 1 \end{bmatrix} \begin{bmatrix} FL \\ FR \end{bmatrix}$$

$$\begin{bmatrix} EL \\ ER \end{bmatrix} = \begin{bmatrix} S, & A \\ A, & S \end{bmatrix} \begin{bmatrix} SL \\ SR \end{bmatrix}$$

$$= \frac{2}{(S+A)(S-A)} \begin{bmatrix} S, & A \\ A, & S \end{bmatrix} \begin{bmatrix} SS'-AA', & SA'-AS' \\ SA'-AS', & SS'-AA' \end{bmatrix} \begin{bmatrix} RL \\ RR \end{bmatrix} + K \begin{bmatrix} S, & A \\ A, & S \end{bmatrix} \begin{bmatrix} 1, & 0 \\ 0, & 1 \end{bmatrix} \begin{bmatrix} FL \\ FR \end{bmatrix}$$

$$= 2 \begin{bmatrix} S', & A' \\ A', & S' \end{bmatrix} \begin{bmatrix} RL \\ RR \end{bmatrix} + K \begin{bmatrix} S, & A \\ A, & S \end{bmatrix} \begin{bmatrix} FL \\ FR \end{bmatrix}$$

Therefore, the two-channel sound field processor converts the front left signal FL, front right signal FR, rear left signal RL, and rear right signal RR for four channels into left sound field signal EL and right sound field signal ER for two channels according to the following relationship equation.

$$\begin{bmatrix} EL \\ ER \end{bmatrix} = 2 \begin{bmatrix} S', & A' \\ A', & S' \end{bmatrix} \begin{bmatrix} RL \\ RR \end{bmatrix} + K \begin{bmatrix} S, & A \\ A, & S \end{bmatrix} \begin{bmatrix} FL \\ FR \end{bmatrix}$$

As described above, in the present invention, in order to reproduce a sound containing a sound field, the conventional sound signals for seven channels are converted into sound signals for three channels so that a listener can feel a rich sound presence even when fewer output speakers are employed than with a conventional audio playback apparatus.

What is claimed is:

1. An audio playback apparatus comprising:

decoding means for converting a digital audio signal into a left signal, a right signal, a center signal, and a surround signal;

sound field processing means for converting said left, right, center and surround signals into a front left signal, a front right signal, a rear left signal, and a rear right signal; and audio processing means for mixing said left, right, front left, front right, rear left and rear right signals according to a relationship equation and converting them into a two channel signal comprised of a left-speaker output signal and a right-speaker output signal.

2. An audio playback apparatus as claimed in claim 1, wherein said audio processing means comprises:

means for converting said front left, front right, rear left and rear right signals according to a transmission function between a sound source and a listener so as to generate a left sound field signal and a right sound field signal;

means for mixing said left sound field signal and said left signal so as to generate said left-speaker output signal; and means for mixing said right sound field signal and said right signal so as to generate said right-speaker output signal.

3. An audio playback apparatus as claimed in claim 2, wherein said audio processing means converts said front left (FL), front right (FR), rear left (RL) and rear right (RR) signals into said left sound field signal (EL) and right sound field signal (ER) according to the relationship equation as follows:

$$\begin{bmatrix} EL \\ ER \end{bmatrix} = 2 \begin{bmatrix} S', & A' \\ A', & S' \end{bmatrix} \begin{bmatrix} RL \\ RR \end{bmatrix} + K \begin{bmatrix} S, & A \\ A, & S \end{bmatrix} \begin{bmatrix} FL \\ FR \end{bmatrix}$$

where S indicates a direr sound transmission function with respect to a front sound source;

A indicates an indirect sound transmission function with respect to said front sound source;

S' indicates a direct sound transmission function with respect to a rear sound source;

A' indicates an indirect sound transmission function with respect to said rear sound sources; and K indicates a coefficient for sound pressure matching between said front sound source and said rear sound source.

4. An audio playback apparatus as claimed in claim 1, further comprising an audio output means for outputting said left-speaker output signal via a left speaker, said right-speaker output signal via a right speaker, and said center signal via a central speaker.

5. An audio playback apparatus as claimed in claim 1, wherein said decoding means is a Dolby pro-logic decoding means.

6. An audio playback method, comprising the steps of:

converting a digital audio signal into a left signal, a right signal, a center signal, and a surround signal;

converting said left, right, center and surround signals into a front left signal, a front right signal, a rear left signal, and a rear right signal; and mixing said left, right, front left, front right, rear left and rear right signals according to a relationship equation and converting them into a two channel signal comprised of a left-speaker output signal and a right-speaker output signal.

7. An audio playback method as claimed in claim 6, wherein said mixing step comprises the steps of:

converting said front left, front right, rear left and rear right signals according to a transmission function between a sound source and a listener so as to generate a left sound field signal and a right sound field signal;

mixing said left sound field signal and said left signal so as to generate said left-speaker output signal; and mixing said right sound field signal and said right signal so as to generate said right-speaker output signal.

8. An audio playback apparatus as claimed in claim 7, wherein said step of converting said front left (FL), front right (FR), rear left (RL) and rear right (RR) signals into said left sound field signal (EL) and right sound field signal (ER), outputs the left and right sound field signals according to the relationship equation as follows:

$$\begin{bmatrix} EL \\ ER \end{bmatrix} = 2\begin{bmatrix} S', & A' \\ A', & S' \end{bmatrix}\begin{bmatrix} RL \\ RR \end{bmatrix} + K\begin{bmatrix} S, & A \\ A, & S \end{bmatrix}\begin{bmatrix} FL \\ FR \end{bmatrix}$$

where S indicates a direct sound transmission function with respect to a front sound source;

A indicates an indirect sound transmission function with respect to the front sound source;

S' indicates a direct sound transmission function with respect to a rear sound source;

A' indicates an indirect sound transmission function with respect to the rear sound source; and K indicates a coefficient for sound pressure matching between said front sound source and said rear sound source.

9. An audio playback method claimed in claim 6, further comprising a step for outputting said left-speaker output signal via a left speaker, said right-speaker output signal via a right speaker, and said center signal via a central speaker.

* * * * *